US009232314B2

(12) United States Patent
Little

(10) Patent No.: US 9,232,314 B2
(45) Date of Patent: Jan. 5, 2016

(54) LOUDSPEAKER CONFIGURATION

(71) Applicant: Sonos, Inc., Santa Barbara, CA (US)

(72) Inventor: Richard Little, Santa Barbara, CA (US)

(73) Assignee: Sonos, Inc., Santa Barbara, CA (US)

( * ) Notice: Subject to any disclaimer, the term of this patent is extended or adjusted under 35 U.S.C. 154(b) by 177 days.

(21) Appl. No.: 14/021,813

(22) Filed: Sep. 9, 2013

(65) Prior Publication Data

US 2015/0071481 A1 Mar. 12, 2015

(51) Int. Cl.

| | |
|---|---|
| ***H04R 1/00*** | (2006.01) |
| ***H04R 7/16*** | (2006.01) |
| ***H04R 9/04*** | (2006.01) |
| *H04R 7/12* | (2006.01) |

(52) U.S. Cl.
CPC ..... *H04R 7/16* (2013.01); *H04R 9/043* (2013.01); *H04R 7/12* (2013.01)

(58) Field of Classification Search
CPC ..... H04R 7/127; H04R 7/12
See application file for complete search history.

(56) References Cited

U.S. PATENT DOCUMENTS

| | | | | |
|---|---|---|---|---|
| 3,862,376 | A * | 1/1975 | White | 381/404 |
| 6,236,733 | B1 | 5/2001 | Kato et al. | |
| 6,757,404 | B2 * | 6/2004 | Takewa et al. | 381/430 |
| 7,236,607 | B2 | 6/2007 | D'Hoogh | |
| 7,570,780 | B2 | 8/2009 | Baeten | |
| 7,599,511 | B2 | 10/2009 | Corynen | |
| 8,422,724 | B2 | 4/2013 | Corynen | |
| 2009/0026007 | A1 | 1/2009 | Corynen | |
| 2010/0208934 | A1 * | 8/2010 | Dohi et al. | 381/398 |
| 2012/0106776 | A1 * | 5/2012 | Liu | 381/413 |

FOREIGN PATENT DOCUMENTS

WO 2012-113281 A1 8/2012

* cited by examiner

*Primary Examiner* — Duc Nguyen
*Assistant Examiner* — Taunya McCarty
(74) *Attorney, Agent, or Firm* — McDonnell Boehnen Hulbert & Berghoff LLP

(57) ABSTRACT

Embodiments are provided for configurations of a loudspeaker. The loudspeaker may include a frame, a magnetic structure having a magnetic gap, a voice coil suspended within the magnetic gap, a first suspension element, a diaphragm, and a second suspension element. The first suspension element may have an inner rim and an outer rim attached to the frame. The diaphragm may have an outer portion and a continuous central portion attached to the voice coil via a first coupler. The outer portion of the diaphragm may be attached to the inner rim of the first suspension element. The second suspension element may have an inner rim and an outer rim attached to the frame. The inner rime of the second suspension element may be attached to the diaphragm via a second coupler along a circumferential middle section of the diaphragm between the continuous central portion and outer portion of the diaphragm.

13 Claims, 3 Drawing Sheets

LOUDSPEAKER CONFIGURATION

CROSS REFERENCE TO RELATED APPLICATIONS

This application is related to commonly-owned U.S. patent application Ser. No. 14/021,831, (entitled "Loudspeaker Assembly Configuration,") filed concurrently herewith, the contents of which are fully incorporated by reference herein.

FIELD OF THE DISCLOSURE

The disclosure is related to consumer goods and, more particularly, to methods, systems, products, features, services, and other items directed to media playback or some aspect thereof.

BACKGROUND

A loudspeaker in the context of the present application is an electroacoustic transducer that produces sound in response to an electrical audio signal input. Originally, non-electrical loudspeakers were developed as accessories to telephone systems. Today, electronic amplification for applications such as audible communication and enjoyment of music has made loudspeakers ubiquitous.

A common form of loudspeaker uses a diaphragm (such as, for example, a paper cone) supporting a voice coil electromagnet acting on a permanent magnet. Based on the application of the loudspeaker, different parameters may be selected for the design of the loudspeaker. For instance, the frequency response of sound produced by a loudspeaker may depend on the shape, size, and rigidity of the diaphragm, and efficiency of the voice coil electromagnet, among other factors. Accordingly, the diaphragm and voice coil electromagnet may be selected based on a desired frequency response of the loudspeaker. In some cases, for improved reproduction of sound covering a wide frequency range, multiple loudspeakers may be used collectively, each configured to optimally reproduce different frequency sub-ranges within the wide frequency range.

As applications of loudspeakers continue to broaden, different loudspeakers designed for particular applications continue to be developed.

BRIEF DESCRIPTION OF THE DRAWINGS

Features, aspects, and advantages of the presently disclosed technology may be better understood with regard to the following description, appended claims, and accompanying drawings where:

DETAILED DESCRIPTION

I. Overview

Embodiments described herein involve loudspeaker configurations that allow for a loudspeaker to have reduced height. The reduced height of the loudspeaker may allow the loudspeaker to be installed in shallow compartments where conventional non-shallow speakers may not otherwise fit.

Figures 1A, 1B, 1C:
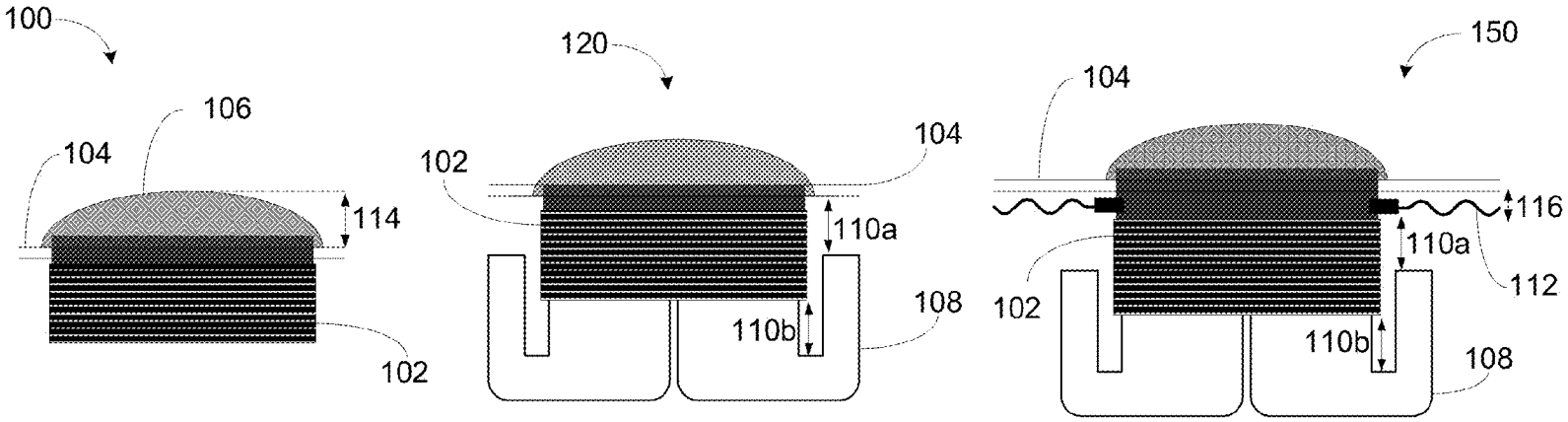
FIGS. 1A-1C show example conventional configurations of a loudspeaker.

In one example, a configuration of a loudspeaker may involve a continuous diaphragm extending across a frame of the loudspeaker and covering a voice coil of an electromagnet transducer of the loudspeaker. In other words, the voice coil is covered by the diaphragm, rather than by a dust cap, as may be the case in conventional loudspeaker configurations. Dust caps for covering voice coils in a loudspeaker may add height to the loudspeaker transducer, thereby adding height to the loudspeaker. FIG. 1A shows an example conventional loudspeaker configuration 100 including a voice coil 102, and diaphragm 104. As shown, the voice coil 102 may protrude the diaphragm 104, and accordingly, a dust cap 106 may be provided to cover the voice coil 102. In this case, the dust cap 106 may add a height 114 to the height of the loudspeaker.

As such, the loudspeaker in this example configuration may have a reduced height because the voice coil is covered by the continuous diaphragm rather than a dust cap. Further, conventional loudspeakers configured with dust caps may require additional component costs and manufacturing time to install the dust cap. As such, a loudspeaker with a continuous diaphragm covering the voice coil may further involve reduced costs and manufacturing time.

In another example, a configuration of the loudspeaker may involve a suspension element, sometimes referred to as a "spider," attached circumferentially between a diaphragm of the loudspeaker and a frame of the loudspeaker. In this example, the spider is attached between the frame and the diaphragm rather than between the frame and a voice coil of an electromagnet transducer of the loudspeaker, as may be the case in conventional speaker configurations. In the case of conventional speaker configurations in which the spider is attached to a voice coil, the voice coil may have a required height to provide sufficient clearance for movement of the spider attached to the voice coil during operation of the loudspeaker.

FIG. 1B shows an example loudspeaker configuration 120 having the voice coil 102 and diaphragm 104 as discussed above in connection to FIG. 1A. In this case, the voice coil 102 may be suspended within a gap of a magnetic structure 108, and may be configured to move along an internal portion of the magnetic structure 108 in response to an electric signal to cause the diaphragm to generate sound. As shown, a distance 110*b* may be provided between the voice coil 102 and a bottom of the gap, and a distance 110*a* may be provided between a top of the outer portion of the magnetic structure 108 and a bottom surface of the diaphragm to provide clearance for the voice coil 102 to move in response to the electric signal. In one example, this clearance may be referred to as an excursion clearance. In some cases, the distance 110*a* and the distance 110*b* may be substantially the same.

FIG. 1C shows an example conventional loudspeaker configuration 130 having the voice coil 102, the diaphragm 104, and magnetic structure 108 as discussed above in connection to FIGS. 1A and/or 1B. In this case, however, a spider 112 may be attached to the voice coil 102 as suggested above. As shown, an additional height 116 on the voice coil 102 is provided to accommodate the attachment of the spider 112 while providing the same excursion clearance of distance 110*a*. As such, a configuration in which the spider is attached between the frame and the diaphragm rather than between the frame and the voice coil may eliminate the need for the additional height on the voice coil, reduce the required height of the voice coil, thereby allowing the loudspeaker to have a reduced height.

As indicated above and further discussed below, the present application involves a loudspeaker configuration. The loudspeaker includes a frame, a magnetic structure having a magnetic gap, a voice coil suspended at least partially within the magnetic gap, and a first suspension element having an inner rim and an outer rim. The first suspension element is attached to the frame along the outer rim of the first suspension element. The loudspeaker configuration also includes a diaphragm having a continuous central portion and an outer portion. The diaphragm is attached to the voice coil via a first coupler to a lower surface of the continuous central portion. The diaphragm is attached to the inner rim of the first suspension element along an outer edge of the outer portion such that the diaphragm suspends from the frame. The loudspeaker configuration further includes a second suspension element having an inner rim and an outer rim. The second suspension element is attached to the frame along the outer rim of the second suspension element. The inner rim of second suspension element is attached to the diaphragm via a second coupler along a circumferential middle section of the diaphragm between the continuous central portion and outer portion of the diaphragm.

In another aspect, a diaphragm structure for a loudspeaker is provided. The diaphragm structure includes a continuous central portion having a lower surface. The lower surface of the continuous central portion is attached to a voice coil of the loudspeaker via a first coupler. The diaphragm structure also includes an outer portion having an outer edge. The outer edge of the outer portion is attached to an inner rim of a first suspension element attached to a frame of the loudspeaker such that the diaphragm suspends from the frame of the loudspeaker. The diaphragm structure further involves a circumferential middle section between the continuous central portion and outer portion of the diaphragm. The circumferential middle section is coupled via a second coupler to an inner rim of a second suspension element. The second suspension element is attached to the frame of the loudspeaker along an outer rim of the second suspension element.

Other embodiments, as those discussed in the following and others as can be appreciated by one having ordinary skill in the art are also possible.

II. Example Loudspeaker Configurations

Figure 2:
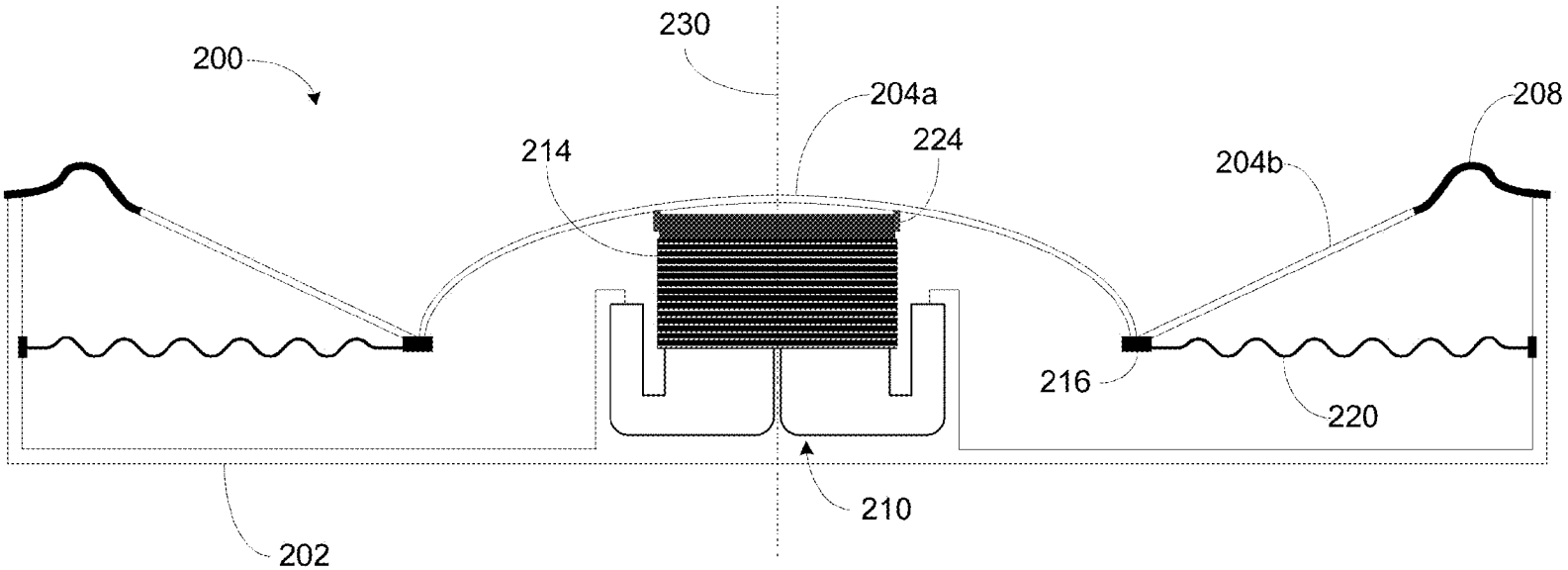
FIG. 2 shows a first example configuration of a loudspeaker, according to an embodiment of the present application.

As suggested above, the present application provides loudspeaker configurations that allow for a loudspeaker to have reduced height. FIG. 2 shows a first example configuration of a loudspeaker 200, according to an embodiment of the present application. The loudspeaker 200 of FIG. 2 is represented as a profile or cut-out view of an example loudspeaker. As such, elements of the loudspeaker 200 are substantially mirrored along a center axis 230. In some cases, mirrored elements may be part of the same loudspeaker component.

As shown, the loudspeaker 200 includes a frame 202, a magnetic structure 210, a voice coil 214, a first suspension element 208, a diaphragm having a continuous central portion 204*a* and an outer portion 204*b*, and a second suspension element 220. The loudspeaker 200 further includes a first coupler 224 and a second coupler 216.

The frame 202 or "basket" of the loudspeaker 200 may be designed to maintain alignment of other components in the loudspeaker. The frame may be, for example, cast from aluminum alloy, stamped from steel sheets, or molded from plastic.

The magnetic structure 210 and the voice coil 214 may be components of an electromagnetic transducer of the loudspeaker 200. As shown, the magnetic structure may have a magnetic gap, and the voice coil 214 may be suspended at least partially within the magnetic gap. The electromagnetic transducer of the loudspeaker 200 may be configured to vibrate longitudinally in response to an electric current run through the voice coil 214.

The diaphragm, which may be attached to the voice coil 214 via the first coupler 224, vibrates in response to the vibration of the voice coil 214, thereby producing sound. The diaphragm may be made of, for example, paper, plastic, metal, or composite materials such as cellulose paper, carbon fiber, and Kevlar, etc. Other materials may also be possible. The sound output level and frequency response of the loudspeaker 200 may be dependent on the material and dimensions of the diaphragm. As shown in FIG. 2, the diaphragm of the loudspeaker 200 may include a continuous central portion 204*a*, and an outer portion 204*b*. In one example, the first coupler 224 may include a cone coupler fitted circumferentially around a portion of the voice coil and adhered to a lower surface of the continuous central portion 204*a* of the diaphragm.

The first suspension element 208 and the second suspension element 220 may make up a suspension system of the loudspeaker 200 configured to keep the voice coil 214 centered in the magnetic gap of the magnetic structure 210 and provide a restoring force to return the diaphragm to a neutral position after movement of the diaphragm responsive to vibrations of the voice coil 214.

The first suspension element 208 or "surround" of the loudspeaker may have an inner rim and an outer rim. As shown in FIG. 2, the first suspension element 208 may be attached to the frame 202 along the outer rim of the first suspension element 208, and an inner rim of the first suspension element 208 may be attached to the diaphragm along an outer edge of the outer portion 204*b* of the diaphragm. The first suspension element 208 may be made of rubber, polyester foam, or corrugated, resin coated fabric, for example. Other materials may also be possible. The sound output level and frequency response of the loudspeaker 200 may be dependent on the material and dimensions of the first suspension element 208.

The second suspension element 220 or "spider" of the loudspeaker 200 may have an inner rim and an outer rim. As shown in FIG. 2, the outer rim of the second suspension element 220 may be attached to the frame 202, and the inner rim of the second suspension element 220 may be attached to the diaphragm via the second coupler 216. In one example, the second coupler 216 may include an adhesive substance configured to bind the second suspension element 220 to the diaphragm. The second suspension element 220 may be made of a treated fabric material, flexible rubber, or flexible elastomer, for example. Other materials may also be possible. The sound output level and frequency response of the loudspeaker 200 may be dependent on the material and dimensions of the second suspension element 220. In one example, the second suspension element 220 may have a concentrically corrugated structure.

The sound output level and frequency response of the loudspeaker 200 may further be dependent on an orientation of the second suspension element 220. In one case, the second suspension element 220 may be oriented such that the suspension element 220 is substantially horizontal or parallel to an orientation of the diaphragm.

As shown, the second suspension element 220 may be attached to the diaphragm along a circumferential middle section of the diaphragm between the continuous central portion 204*a* and outer portion of the diaphragm 204*b*. In one example, the second coupler 216 may be a circumferential coupler concentric with the continuous central portion 204*a* and outer portion 204*b* of the diaphragm. In this case, the circumferential middle section of the diaphragm may be defined by the circumferential second coupler 216.

As shown in FIG. 2, the continuous central portion 204*a* of the diaphragm may include a continuous dome-shaped diaphragm and the outer portion 204*b* of the diaphragm may include a cone-shaped diaphragm concentrically positioned about the continuous central portion 204*b* of the diaphragm. In one example the cone-shaped diaphragm may have a lower circumferential opening and an upper circumferential opening wider than the lower circumferential opening. In this example, an outer rim of the continuous dome-shaped diaphragm may be attached to an edge of the lower circumferential opening of the cone-shaped diaphragm.

In one case, the continuous dome-shaped diaphragm may be coupled to the cone-shaped diaphragm along the circumferential middle section of the diaphragm. As such, the continuous dome-shaped diaphragm may be coupled to the cone-shaped diaphragm via the second coupler 216, which also attaches the second suspension element 220 to the diaphragm along the circumferential middle section of the diaphragm. For instance, the second suspension element 220 may be attached to the edge of the lower circumferential opening of the cone-shaped diaphragm along the circumferential middle section of the diaphragm. In some instances, the circumferential middle section of the diaphragm may be defined by where the continuous dome-shaped diaphragm and the cone-shaped diaphragm are coupled.

As one having ordinary skill in the art may appreciate, the sound output level and frequency response of the loudspeaker 200 may be dependent on the sizes and depths of the continuous dome-shaped diaphragm and cone-shaped diaphragm.

Figure 3:
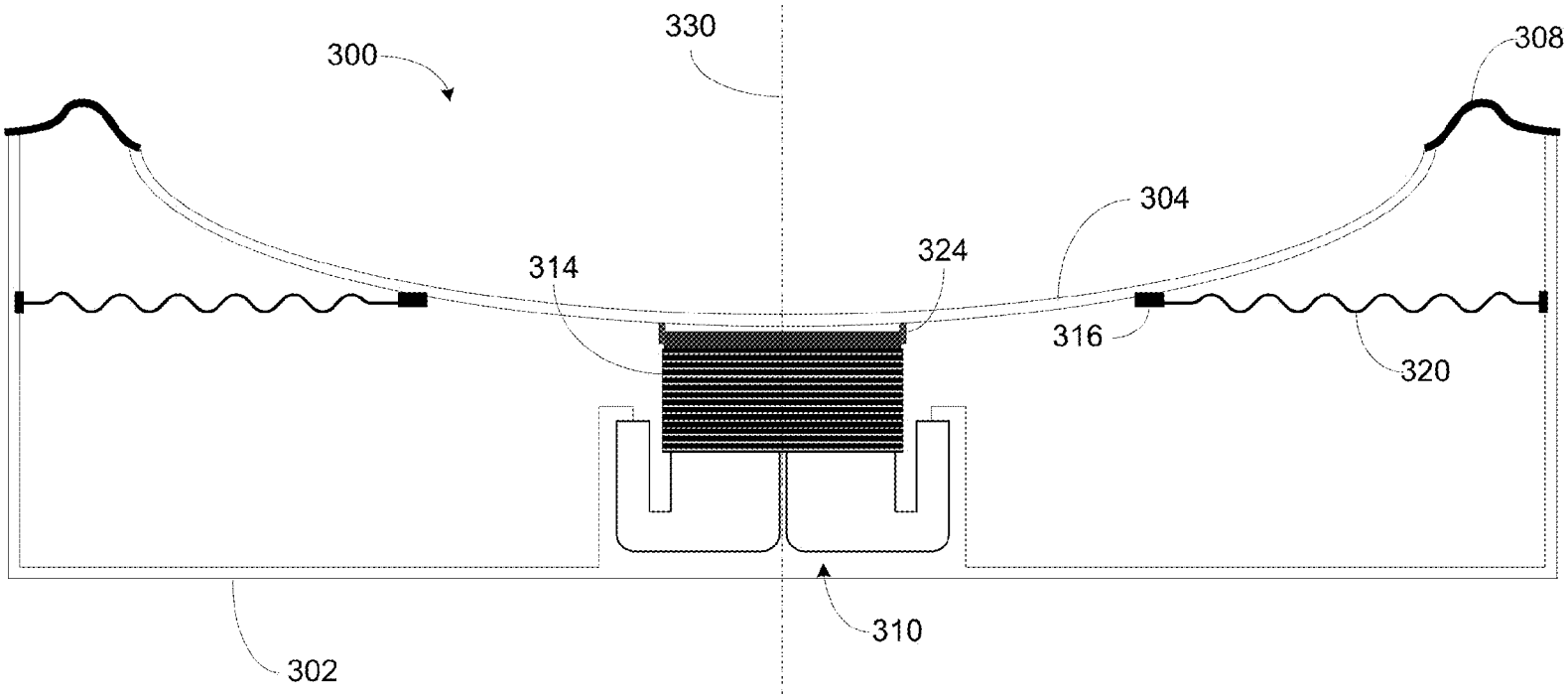
FIG. 3 shows a second example configuration of a loudspeaker, according to an embodiment of the present application.

FIG. 3 shows a second example configuration of a loudspeaker 300, according to an embodiment of the present application. Similar to the loudspeaker 200 of FIG. 2, the loudspeaker 300 of FIG. 3 is represented as a profile or cut-out view of an example loudspeaker. As such, elements of the loudspeaker 300 are substantially mirrored along a center axis 330. In some cases, mirrored elements may be part of the same loudspeaker component.

As shown, the loudspeaker 300 includes a frame 302 similar to that of the frame 202, a magnetic structure 310 similar to that of the magnet structure 210, a voice coil 314 similar to that of the voice coil 214, a first suspension element 308 similar to that of the first suspension element 208, and a second suspension element 320 similar to that of the second suspension element 220. As with the loudspeaker 200, the loudspeaker 300 also includes a first coupler 324 similar to that of the first coupler 224 and a second coupler 316 similar to that of the second coupler 216.

The loudspeaker 300 also includes a diaphragm 304, which like the diaphragm of loudspeaker 200, may be made of, for example, paper, plastic, metal, or composite materials such as cellulose paper, carbon fiber, and Kevlar, etc., and may be configured to produce sound responsive to vibrations of the voice coil 314 attached to the diaphragm 304 via the first coupler 324.

Different from the diaphragm of loudspeaker 200, the diaphragm 304 may have a continuous central portion that may be structurally indistinguishable from an outer portion of the diaphragm 304. In other words, the diaphragm 304 may be of a single composition of material, rather than a combination of a continuous dome-shaped diaphragm and a cone-shaped diaphragm as is the case of loudspeaker 200. As such, a circumferential middle section of the diaphragm 304 may simply be defined by where the second coupler 316 attaches the diaphragm 304 to the second suspension element 320.

Nevertheless, a concentric position of the circumferential middle section where the second coupler 316 attaches the diaphragm 304 to the second suspension element 320 is not arbitrary. As one having ordinary skill in the art may appreciate, the sound output level and frequency response of the loudspeaker 300 may be dependent on the concentric position of the second coupler 316.

Other example configurations and embodiments may also be possible.

IV. Conclusion

As indicated above, the present application involves a loudspeaker configuration. The loudspeaker includes a frame, a magnetic structure having a magnetic gap, a voice coil suspended at least partially within the magnetic gap, and a first suspension element having an inner rim and an outer rim. The first suspension element is attached to the frame along the outer rim of the first suspension element. The loudspeaker configuration also includes a diaphragm having a continuous central portion and an outer portion. The diaphragm is attached to the voice coil via a first coupler to a lower surface of the continuous central portion. The diaphragm is attached to the inner rim of the first suspension element along an outer edge of the outer portion such that the diaphragm suspends from the frame. The loudspeaker configuration further includes a second suspension element having an inner rim and an outer rim. The second suspension element is attached to the frame along the outer rim of the second suspension element. The inner rim of second suspension element is attached to the diaphragm via a second coupler along a circumferential middle section of the diaphragm between the continuous central portion and outer portion of the diaphragm.

In another aspect, a diaphragm structure for a loudspeaker is provided. The diaphragm structure includes a continuous central portion having a lower surface. The lower surface of the continuous central portion is attached to a voice coil of the loudspeaker via a first coupler. The diaphragm structure also includes an outer portion having an outer edge. The outer edge of the outer portion is attached to an inner rim of a first suspension element attached to a frame of the loudspeaker such that the diaphragm suspends from the frame of the loudspeaker. The diaphragm structure further involves a circumferential middle section between the continuous central portion and outer portion of the diaphragm. The circumferential middle section is coupled via a second coupler to an inner rim of a second suspension element. The second suspension element is attached to the frame of the loudspeaker along an outer rim of the second suspension element.

The descriptions above disclose various example systems, apparatus, and articles of manufacture. Such examples are merely illustrative and should not be considered as limiting. Accordingly, while the above describes example systems, apparatus, and/or articles of manufacture, the examples provided are not the only way(s) to implement such systems, apparatus, and/or articles of manufacture.

Additionally, references herein to an "embodiment" means that a particular feature, structure, or characteristic described in connection with the embodiment can be included in at least one example embodiment of the invention. The appearances of this phrase in various places in the specification are not necessarily all referring to the same embodiment, nor are separate or alternative embodiments mutually exclusive of other embodiments. As such, the embodiments described herein, explicitly and implicitly understood by one skilled in the art, can be combined with other embodiments.

Numerous specific details are set forth to provide a thorough understanding of the present disclosure. However, it is understood to those skilled in the art that certain embodiments of the present disclosure can be practiced without certain, specific details. In other instances, well known methods, procedures, components, and circuitry have not been described in detail to avoid unnecessarily obscuring aspects of the embodiments. Accordingly, the scope of the present disclosure is defined by the appended claims rather than the forgoing description of embodiments.

I claim:

1. A loudspeaker comprising:

a frame;

a magnetic structure having a gap;

a voice coil suspended at least partially within the gap;

a first suspension element having an inner rim and an outer rim, wherein the first suspension element is attached to the frame along the outer rim of the first suspension element;

a diaphragm formed into a single portion of material having a convex surface that (i) extends from a center axis of the loudspeaker to the inner rim of the first suspension element and (ii) faces the frame, wherein the diaphragm is attached to the voice coil via a first coupler at the convex surface, and wherein the diaphragm is attached to the inner rim of the first suspension element along an outer edge of the diaphragm such that the diaphragm suspends from the frame; and a second suspension element having an inner rim and an outer rim, wherein the second suspension element is attached to the frame along the outer rim of the second suspension element, and wherein the inner rim of second suspension element is attached to the diaphragm via a second coupler.

2. The loudspeaker of claim 1, wherein the first coupler surrounds a portion of the voice coil.

3. The loudspeaker of claim 1, wherein the second coupler comprises an adhesive substance configured to bind the second suspension element to the diaphragm.

4. The loudspeaker of claim 1, wherein the second suspension element is substantially parallel to a center portion of the convex surface.

5. The loudspeaker of claim 1, wherein the second suspension element is constructed of one or more of the following: (a) a treated fabric material, (b) flexible rubber, and (c) flexible elastomer.

6. The loudspeaker of claim 1, wherein the second suspension element has a concentrically corrugated structure.

7. A diaphragm of a loudspeaker, the diaphragm comprising:

a convex surface formed from a single portion of material that (i) extends from a center axis of the loudspeaker to an inner rim of a first suspension element of the loudspeaker and (ii) faces a frame of the loudspeaker, wherein the convex surface is attached to a voice coil of the loudspeaker via a first coupler, and wherein an outer rim of the first suspension element is attached to the frame; and outer edge, wherein the outer edge is attached to the inner rim such that the diaphragm suspends from the frame, wherein the convex surface is coupled via a second coupler to an inner rim of a second suspension element of the loudspeaker, and wherein the second suspension element is attached to the frame along an outer rim of the second suspension element.

8. The diaphragm structure of claim 7, wherein the loudspeaker comprises a magnetic structure having a gap, and wherein the voice coil is suspended at least partially within the gap.

9. The diaphragm of claim 7, wherein the first coupler surrounds a portion of the voice coil.

10. The diaphragm of claim 7, wherein the second coupler comprises an adhesive substance configured to bind the second suspension element to the diaphragm.

11. The diaphragm of claim 7, wherein the second suspension element is substantially parallel to a center portion of the convex surface.

12. The diaphragm of claim 7, wherein the second suspension element is constructed of one or more of the following: (a) a treated fabric material, (b) flexible rubber, and (c) flexible elastomer.

13. The diaphragm of claim 7, wherein the second suspension element has a concentrically corrugated structure.

* * * * *

UNITED STATES PATENT AND TRADEMARK OFFICE

CERTIFICATE OF CORRECTION

PATENT NO. : 9,232,314 B2
APPLICATION NO. : 14/021813
DATED : January 5, 2016
INVENTOR(S) : Richard Little It is certified that error appears in the above-identified patent and that said Letters Patent is hereby corrected as shown below:

Title Page

Fifth line from the bottom of the Abstract: replace the word “rime” with “rim”

Claims

Column 8 line 18 (claim 7): add the word “an” immediately before the phrase “outer edge, wherein”

Signed and Sealed this
Nineteenth Day of April, 2016

Michelle K. Lee

Michelle K. Lee
*Director of the United States Patent and Trademark Office*